US009556722B2

(12) United States Patent
Elmbo

(10) Patent No.: US 9,556,722 B2
(45) Date of Patent: Jan. 31, 2017

(54) METHOD FOR ESTABLISHING A RELIEF WELL

(71) Applicant: Maersk Supply Service A/S, Copenhagen K (DK)

(72) Inventor: Niels Peter Elmbo, Kokkedal (DK)

(73) Assignee: MAERSK SUPPLY SERVICE A/S, Copenhagen K (DK)

( * ) Notice: Subject to any disclaimer, the term of this patent is extended or adjusted under 35 U.S.C. 154(b) by 114 days.

(21) Appl. No.: 14/372,996

(22) PCT Filed: Jan. 18, 2013

(86) PCT No.: PCT/DK2013/050017

§ 371 (c)(1),
(2) Date: Jul. 17, 2014

(87) PCT Pub. No.: WO2013/107462

PCT Pub. Date: Jul. 25, 2013

(65) Prior Publication Data

US 2014/0345856 A1 Nov. 27, 2014

Related U.S. Application Data

(60) Provisional application No. 61/587,930, filed on Jan. 18, 2012.

(30) Foreign Application Priority Data

Jan. 18, 2012 (DK) ..... 2012 70029

(51) Int. Cl.
*E21B 43/30* (2006.01)
*E21B 7/00* (2006.01)
(Continued)

(52) U.S. Cl.
CPC ..... *E21B 43/305* (2013.01); *E21B 7/00* (2013.01); *E21B 17/02* (2013.01); *E21B 33/13* (2013.01)

(58) Field of Classification Search
CPC ..... E21B 43/305; E21B 7/00
See application file for complete search history.

(56) References Cited

U.S. PATENT DOCUMENTS 3,003,557 A * 10/1961 Huitt ..... E21B 35/00 166/271
3,313,361 A * 4/1967 McCullough ..... E21B 7/06 166/301
(Continued)

FOREIGN PATENT DOCUMENTS

CN 1508380 A 6/2004
GB 857535 A 12/1960
(Continued)

OTHER PUBLICATIONS

International-Type Search Report for Application No. PA 2012 70029, mailed Jun. 21, 2012.
(Continued)

*Primary Examiner* — Nicole Coy
(74) *Attorney, Agent, or Firm* — Brinks Gilson & Lione

(57) ABSTRACT

The invention relates to a method of extracting oil from a reservoir. The method comprises the following steps: drilling of a first well; mounting and cementing of well pipes in the first well; mounting of a Blow Out Preventer or Lubricator in the top of the well. At a distance from this well, a second well is drilled against a section of the first well such that the second well gets into operational contact with the first well. Hereafter well pipes are mounted and cemented in the second well; a Blow Out Preventer or Lubricator is mounted in the top of the second well; where after the
(Continued)

drilling from the first or the second well is continued down into the reservoir.

18 Claims, 7 Drawing Sheets

(51) Int. Cl.
*E21B 17/02* (2006.01)
*E21B 33/13* (2006.01)

(56) References Cited

U.S. PATENT DOCUMENTS

| | | | | |
|---|---|---|---|---|
| 4,133,383 | A | 1/1979 | Ely | |
| 4,323,118 | A | 4/1982 | Bergmann | |
| 4,329,647 | A | 5/1982 | Freedman | |
| 4,436,154 | A * | 3/1984 | Vann | E21B 29/08 166/271 |
| H614 | H * | 4/1989 | Norman, Sr. | E21B 7/04 175/45 |
| 5,064,006 | A | 11/1991 | Waters et al. | |
| 6,732,797 | B1 | 5/2004 | Watters et al. | |
| 2011/0247827 | A1 | 10/2011 | Humphreys | |
| 2012/0001100 | A1 | 1/2012 | Hubbell | |
| 2013/0037272 | A1 * | 2/2013 | Dale | E21B 21/00 166/363 |

FOREIGN PATENT DOCUMENTS

| | | |
|---|---|---|
| GB | 22544430 | 10/1992 |
| GB | 1103529 A | 10/2014 |
| RU | 2379492 C2 | 1/2010 |
| SU | 721523 | 3/1980 |
| SU | 1626908 | 2/1994 |
| WO | 201143034 A1 | 4/2011 |

OTHER PUBLICATIONS

Danish Search Report for Application No. PA 2012 70029, Completed Aug. 17, 2012.

International Preliminary Report on Patentability, completed Aug. 14, 2014.

Wayne Drash, "Hurricanes could derail August oil leak deadline—CNN", Jun. 4, 2010.

International Search Report and Written Opinion for PCT:DK2013:050017, mailed Nov. 11, 2013.

Igrevskii VI et al., Prevention and elimination of oil and gas fountains, Moscow, Nedra, 1974, p. 56-66.

Malevansky VD et al., Hydrodynamic calculations shut-off fountains modes in oil and gas wells, Moscow, Nedra, 1990, pp. 179.

* cited by examiner

METHOD FOR ESTABLISHING A RELIEF WELL

RELATED APPLICATIONS

This application claims the benefit under 35 U.S.C. §371 of International Patent Application No. PCT/DK2013/050017, having an international filing date of Jan. 18, 2013, which claims priority to Danish Application No. PA 2012 70029, filed Jan. 18, 2012 and U.S. Provisional Application No. 61/587,930, filed Jan. 18, 2012, the contents of all of which are incorporated herein by reference in their entirety.

When a well for extraction of oil or gas is established, this is done through different soil strata, and for natural reasons it is not possible to predict everything that might happen during the drilling process per se; for instance you could unexpectedly hit strata in which there is gas under very high pressure.

The drilling per se takes place through a hollow string (drilling pipe/riser pipe/riser). A drilling string with a drilling head/drilling crown is passed through the riser pipe, and drilling mud is pumped out through the drilling head/drilling crown, the mud being recirculated to the drilling unit or a ship on the surface via the annular cavity between the drilling string and the riser pipe/drilling pipe.

It is the purpose of the drilling mud to wash away and transport the drilled out materials (bore chips), because thereby the drilling head constantly works in new material and lubricates the drilling head/drilling crown.

By changing the density of the drilling mud it is also possible to control the pressure in the riser pipe/drilling pipe, and the drilling mud thus also fulfils a safety function by pressure equalizing with the surroundings in the well. At drillings, continuous measuring thus takes'place where the quantity of drilling mud pumped down into the well, via the drilling head, is compared with the quantity of drilling mud returning from the well through the annular cavity of the drilling pipe. If the quantity of returned drilling mud starts increasing relatively to the quantity of drilling mud pumped out through the drilling head, this is an indication that the drilling mud in the well and the drilling pipe gets mixed with seeping in gas from reservoir in the underground.

In such situations it is possible by regulating the density of the drilling mud to prevent the situation from getting out of control and thus ending in a so-called blow out where the well is no longer under control. The drilling mud along with a safety valve—a so-called Blow Out Preventer (BOP)—are placed at the top of the well—an important safety measure.

Nevertheless—as in the Mexican Gulf with the drilling rig Deepwater Horizon, which drilled a well called Macondo—the unfortunate situation sometimes arises that control of a well is lost because of rising gas with the resulting environmental consequences.

In such situations, a last resort in order to re-establish control of the well may turn out to be to simply drill a new relief well in order, via this well, to intervene in and control/kill the well that is out of control.

Such a well is called a relief well.

A relief well can be drilled so as to penetrate the uncontrolled well whereafter control of the runaway well is regained by pumping in sundry high-viscous substances. Such high-viscous substances may be drilling mud consisting of brine (salt solutions), slurried clay products, such as Baryte or Bentonite, but also water can be used in certain situations. The substances are well-known to the skilled person and will not therefore be explained in more detail.

Typically, but not necessarily, the drilling per se down to operational distance (the words: "operational distance" are explained below) from the runaway well takes place by a so-called directional drilling, which means that the direction of drilling is guided towards a section of the runaway well. To the skilled person, directional drilling is a well-known technology and it will not therefore be explained further.

The localisation per se of the runaway well is also well-known technology, and the position thereof can be determined as described in U.S. Pat. No. 4,329,647A (Method for determining distance and direction from an open well to a cased well using resistivity and directional survey data).

However, the position of the runaway well can also be determined by other methodologies, for example acoustically, as disclosed in e.g. GB patent specification no. GB1103529A, or by means of magnetic measurements, as disclosed in, for example, U.S. Pat. No. 5,064,006A.

Position determination can also be effected by a combination of acoustic and magnetic measurements, as disclosed for example in GB patent specification no. GB2254430A.

A relief well is often made such as to penetrate the runaway well.

Subsequently, control of the runaway well is achieved in that, via the relief well, a suitable substance is injected in—typically the bottom—of the runaway well. To be begin with, this substance may be drilling mud having such high density that the pressure from the drilling mud exceeds the pressure (the pore pressure) from the inflowing oil/hydrocarbon.

Drilling mud per se will not normally be a permanent solution, for which reason control of a runaway well is usually sought by for example injecting cement far down in the well, thereby creating a stable shutdown of the well.

This is called killing a well.

From experience it is known that injection of cement is a safe and reliable way of permanently killing a well. Other methodologies known to the skilled person can of course also be used for permanently closing a well.

A relief well must not necessarily penetrate the runaway well; it is merely to be drilled in to so-called "operational distance" from the runaway well.

The words "operational distance" are taken to mean that the relief well is drilled so closely to the runaway well that it can be penetrated from the relief well, thereby gaining control of the runaway well.

As described in U.S. Pat. No. 3,003,557 it is possible to control a runaway well e.g. by drilling a relief well at operational distance therefrom and subsequently form a passage (fracture) between the two wells, which is then used for injecting a substance that may bring about control of the runaway well. Other methodologies for establishing fluid-wise communication between two wells at operational distance could involve, for instance, the use of explosives.

The abovementioned catastrophe in the Mexican Gulf has entailed that today it is a regulatory requirement in many places that in case of drillings at sea there is security that another drilling rig can rapidly get to the well and drill a relief well in the event of an accident. As an extreme consequence this could mean that the company behind the drilling must simply make an extra drilling unit available at the individual drillings.

This is extremely expensive, and in practice the problem is solved—for example in the Mexican Gulf—in that companies drilling close to each other mutually agree that each party is at the disposal of the other party if necessary. Far from in all places are the drilling rigs positioned so closely, however, that such an agreement makes sense, and in remote areas round the world it may be necessary, as mentioned above, to simply make an extra drilling available at the individual drilling.

None of these solutions are optimal as regards time, and in particular the last-mentioned solution is very expensive.

It is the object of the invention to devise a method by which it is possible to minimize i.a. the above drawbacks.

According to the invention this is achieved in that the method comprises the following steps: drilling of a first well; mounting and cementing of well pipes in the first well; mounting of a Blow Out Preventer or Lubricator in the top of the first well; drilling, at a distance from this well, of a second well against a section of the first well such that the second well gets into operational contact with the first well; mounting and cementing of well pipes in the second well; mounting of a Blow Out Preventer or Lubricator in the top of the second well; whereafter the drilling from the first or the second well is continued down into the reservoir.

If at the same time, before or while establishing an actual well, an extra well is established which may serve as relief well, rapid access to the actual well is facilitated if an accident should occur while the latter is being finished.

Moreover, as the relief well is furthermore provided with i.a. Blow Out Preventer there is no longer a need for a drilling rig, a drilling unit, or a semisubmersible for operating the relief well. Because, as it is, via this relief well minor units equipped with far simpler equipment can handle the task of intervening in the well associated with the relief well. The smaller unit could for example be a so-called supply ship provided with apparatus for carrying out e.g. a so-called well killing either through preinstalled tube connections to the BOP, or through a so-called coiled tubing operation.

If the drilling takes place in icy waters, the drilling unit will normally be assisted by one or more icebreakers. If this icebreaker is provided with equipment for being able to intervene in a main well via a relief well and thereby to regain control of the main well, you could either let the drilling unit drill a relief well; provide it with casing and Blow Out Preventer; drill the oil well at operational distance from the relief well; or drill a new well; whereafter the drilling unit can drill down into the (presumably) oil bearing actual formation.

If an accident happens during the operation where the drilling unit drills down into the oil containing formation and you lose control of the well, and where the drilling unit perhaps even sinks, the icebreaker—which assists during the operation—will be able to make the necessary intervention in the well via the already drilled relief well.

In one embodiment the two wells meet, whereby it is obtained that a minimum of work is required in order to establish a fluid connection between the two wells so that a substance can be pumped from the relief well with the purpose of gaining control of and/or permanently closing (killing) the second well.

In one embodiment the method comprises the step of connecting a riser pipe between a drilling unit and the Blow Out Preventer on the well through which the drilling to the reservoir is carried out.

When the method according to the invention is used on wells drilled at sea by drilling units or so-called semisubmersible(s), the drilling operations will take place through a riser pipe extending between the Blow Out Preventer and the drilling unit/semisubmersible.

In one embodiment, the relief well is filled up wholly or partially with cement or other hardening material.

This prevents blow outs via the relief well per se. The hardened material can then be removed in a subsequent drilling operation if you have to go via the relief well in order to control the well with which it is in operational contact.

In one embodiment, a drilling tool is placed in the relief well, which tool is left in the well so that this tool can carry out a specific task, such as for example establishing connection to the other well, if need be. In a further embodiment hereof, this tool is hydraulic.

By making the drilling tool hydraulic it can be activated via a so-called coiled tubing operation, where from the top of the well you can connect the tool and operate it hydraulically from, for example, a ship on the surface.

As compared with drilling a completely new well, this is a very simple operation and it therefore does not require a drilling rig, but can be carried out by ships of the size normally used as supply ships or—if the drilling takes place in icy waters—by an assisting icebreaker.

In one embodiment, a fluid of suitable density is introduced into the relief well. By suitable density is meant a density (bulk density) being so adjusted that the fluid can be used for injecting into the main well with the purpose of stopping a flow therein. This fluid may be drilling mud and/or brine, i.e. salt water, where the salt concentration is so high that the density of the water has increased to such extent that it can be used for killing an oil well. Brine typically contains more than 50 grams of salt per liter.

In a further embodiment, the fluid constitutes a liquid column, which should be taken to mean that the relief well is not completely filled up. Thus, when the relief well is not completely filled with fluid, a drilling tool may be positioned on one side or both sides of the liquid column, said tool being capable of performing a specific task, for example establishing connection to a second well, or injecting the fluid into a second well.

In one embodiment, a hydraulic tool is positioned below or in the lower part of the liquid column.

In a further embodiment, the said hydraulic tool may be provided with a hydraulic connection extending from the tool and through the liquid column of brine/drilling mud to the top of the well. The hydraulic connection may be of the type coiled tubing, but other tube/pipe connections can of course also be used.

Thus, a hydraulic tool connected to the top of the well can readily be connected to a drilling rig or a ship and thereby be provided with hydraulic energy so that it can carry our relatively energy demanding tasks, such as for example drilling into a second well. The column of drilling mud/brine can subsequently be injected into this second well, whereby control can be gained of it. The advantage of providing the relief well with drilling mud already while establishing it, with or without drilling tool, and before commissioning it, is that the drilling mud/brine is available at all times.

Thereby ships/drilling rigs which do not have the normally—for killing/control of a well—required quantity of drilling mud can still kill/or bring about control of a runaway well provided that the quantity of drilling mud already present in the relief well constitutes a sufficient quantity for killing the well, or together with the quantity of drilling mud present on board the ship suffices for killing the well.

Besides being of the mechanical type (such as hydraulic), the connection from the tool positioned in the relief well may also be electric such that the energy supply for the tool takes place via a wire extending therefrom and through the column of fluid to the top of the well.

The tool may also be provided with a communication unit which makes possible transfer of data between the tool and the top of the well. The data may comprise an actual control of the tool and/or transfer of physical parameters, such as for example pressure and/or temperature, or control parameters as to the functionality of the tool.

This communication may pass through an actual wire or optical fibre extending from the tool and to the top of the well, but the communication may also take place auditively, via, for example, the liquid column or pipes, such as a possible lining of steel pipes (casing).

When the words "the top of the well" are used in this application, they are not to be interpreted in a limiting manner, such as for example just to a Blow Out Preventer, but rather be interpreted in the broadest sense so as to comprise any installation known to the skilled person, which is used at the top of a well for termination thereof.

The words "that something extends to the top of the well" should also be interpreted broadly and mean any device known to the skilled person, which is terminated at the top of the well in such functional manner that it can be activated/used via the top of the well.

In a further embodiment, the drilling tool comprises a so-called well tractor which is mutually adapted to a section of the relief well so as to be firmly lockable.

By furthermore designing such a well tractor in such a manner that together with casing in the relief well it constitutes a fluid-tight device, it is possible to prevent fluid from rising up through the relief well.

In one embodiment, the relief well is established at a distance from the main well, the distance being adapted to the length of the riser pipe in such a way that, in the event that it sinks, a drilling unit/semisubmersible carrying out a drilling cannot fall down onto the relief well or its Blow Out Preventer.

As the riser pipe through which the actual oil drilling takes place connects the drilling unit to the Blow Out Preventer, the drilling unit cannot—as long as it is connected to the Blow Out Preventer—be wrecked at the seafloor at a distance from the Blow Out Preventer which is longer than the riser pipe per se.

By following the method described in the previous paragraphs—and adapting the distance between relief well and the actual well such that essentially it is greater than the distance between Blow Out Preventer and drilling unit, for example so that the distance between the two wells is greater than the water depth, it is possible to prevent accidents where a wrecked drilling unit settles down on top of the relief well and thereby damages its Blow Out Preventer/Lubricator.

Embodiments of the invention will now be explained with reference to the drawing, in which FIG. 1 schematically shows two situations: A and B, in which a relief well and an actual well, respectively, is drilled for oil;

Figure 1:
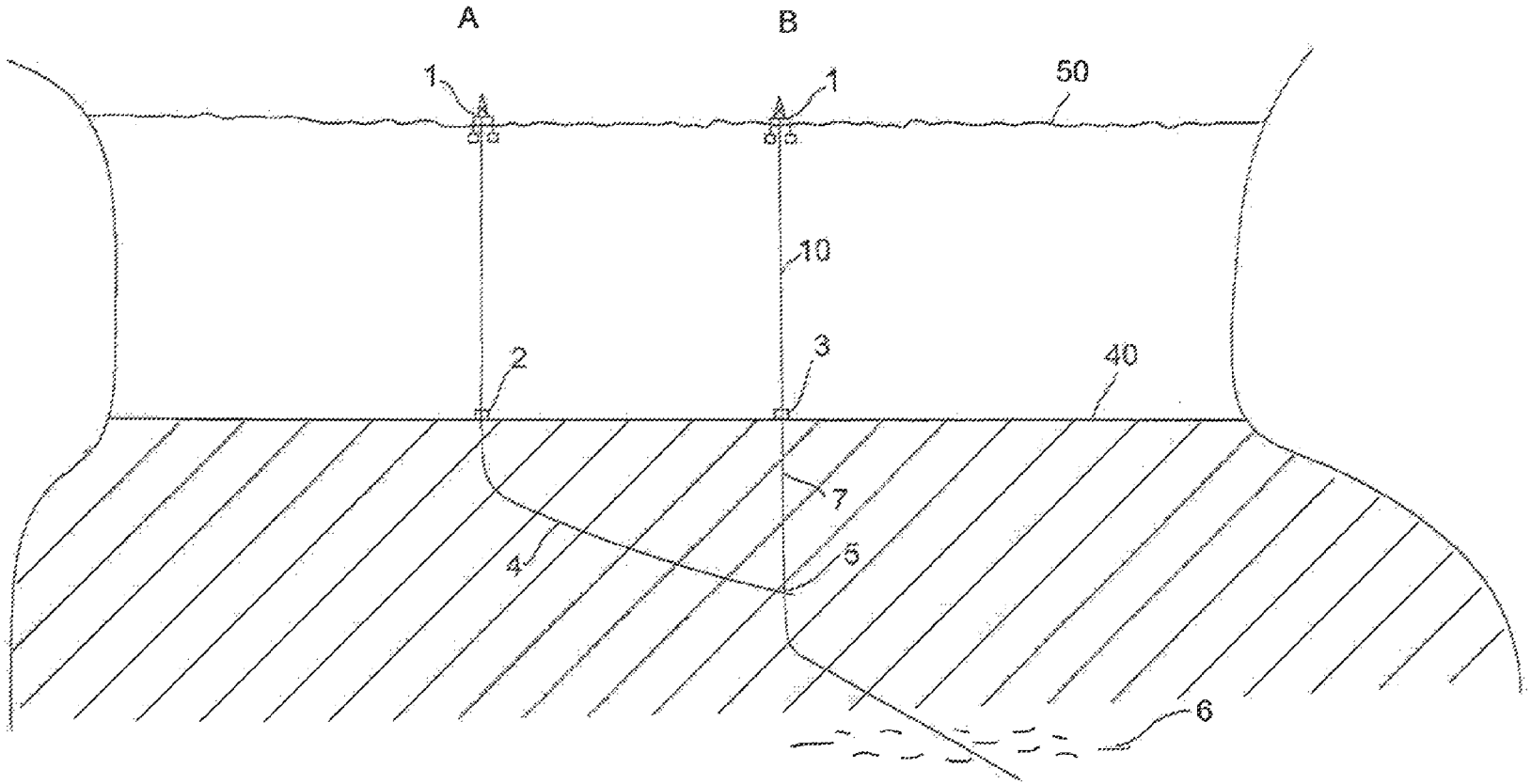

FIG. 1 shows two steps: A and B in a method of establishing a well which extends from an oil reservoir 6 in a sea bottom 40 via a riser pipe 10 to a ship on the surface of the sea 50. In the embodiment shown, the vessel is a so-called semisubmersible 1, but other vessels, such as for example drilling ships well-suited for drilling at sea, can, of course, also be used for carrying out the invention. The invention can also be carried out on land, so the drilling rig may also be of the type standing on the sea floor.

In situation A, the semisubmersible 1 is establishing a first well 4. This well extends from the sea bottom 40 and its extension is restricted to only extending to an area (depth) where it can be intersected by a well which is drilled in another step.

It is the purpose of the well being drilled in step A to be able to serve as a so-called relief well to a second well 7 extending all the way down into a reservoir 6, which contains carbonhydrids (oil or gas).

A relief well is a well which is normally drilled in order to gain control of a second well which for some reason has run away and is out of control.

A relief well is therefore often something that you make as an extreme consequence of a situation which is completely out of control. In these situations, a so-called blow out has usually happened, where oil or gas has had such high pressure that it has forced its way out through the top of the well.

In order to prevent blow outs, drilling platforms are equipped with a number of safety mechanisms, including a so-called Blow Out Preventer 2, which is a valve which is usually placed at the well head. The Blow Out Preventer is equipped with a number of safety mechanisms which are to prevent the well from getting out of control.

Of these, the most radical ones are the so-called "blind shear rams", which comprise knives which are simply capable of sealing the well by cutting through the riser pipe (riser) and the drilling string progressing through the Blow Out Preventer. Other mechanisms are intended for shutting off the connection between the well and the drilling unit so that a pressure increase can be alleviated in a controlled manner in order to regain control of the well pressure.

Another safety mechanism is the so-called drilling mud, which is used for washing away drilling chips. The drilling mud is pumped down through the pipe on which the cutting head sits and continues out through the cutting head, which is called the drilling head.

The drilling mud along with the drilling chips hereafter run to the surface. This takes place in the annular interspace between the drilling string and the sides in the well per se.

By comparing the quantity of drilling mud which is pumped down into the well with the quantity coming up again it is possible to predict, for example, gas ingress or elevated pressure in the well. For if the quantity coming up via the annular cavity increases, this is a clear sign that something in the well is somehow pressing up drilling mud. This might be gas expanding on its way up to the surface. It might also be oil (or gas) floating into the well at high pressure.

An actual blow out is normally prevented by simply increasing the density of the drilling mud, because thereby the pressure in the annual cavity is increased.

This is normally done undramatically, and it is an entirely normal procedure; but alas, all safety mechanisms can fail.

As was seen in the Mexican Gulf with the semisubmersible Deep Water Horizon, things could go so wrong even that the vessel which carried out the drilling down into the reservoir gets so damaged that it sinks. In such situations the relief well must be drilled by a quite different vessel, which could be very far away.

As is seen in FIG. 1 in situation A, the drilling unit 1 is carrying out a drilling operation in which it establishes the well 4.

In so doing, it also provides the well with a lining of steel pipes (casing) which is attached by cement (however, this feature is not shown in the figure). The purpose with the casing is partly to stabilize the well, but it is also the casing that the abovementioned valve, the Blow Out Preventer 2, can be attached to/mounted on.

A special type of Blow Out Preventer is called a Lubricator, and the method according to the invention can just as well be performed with Lubricators.

The well in situation A is drilled so as to extend through the area in which a second oil well extending down into an oil reservoir is to be drilled.

In situation B it is seen that the vessel, the drilling unit 1, at a distance from the well which was drilled in situation A, now drills an actual oil well 7, which extends down into the reservoir 6.

This drilling is performed directionally. i.e. that during the drilling, the direction of the drilling has been controlled such that the well that was established in operation A is drilled through. Fluid communication has thereby been established between the two wells. If drilling operation B should later on experience a blow out, it is now possible to intervene and stop the well 7 via the well 4.

The directional drilling can be performed e.g. by means of a technology where you magnetically detect the casing with which well 4 is lined, but also other technologies, such as for example acoustic methodologies, can be used for localising well 4.

Like in situation A, the well in situation B is also provided with casing and Blow Out Preventer.

Figure 2:
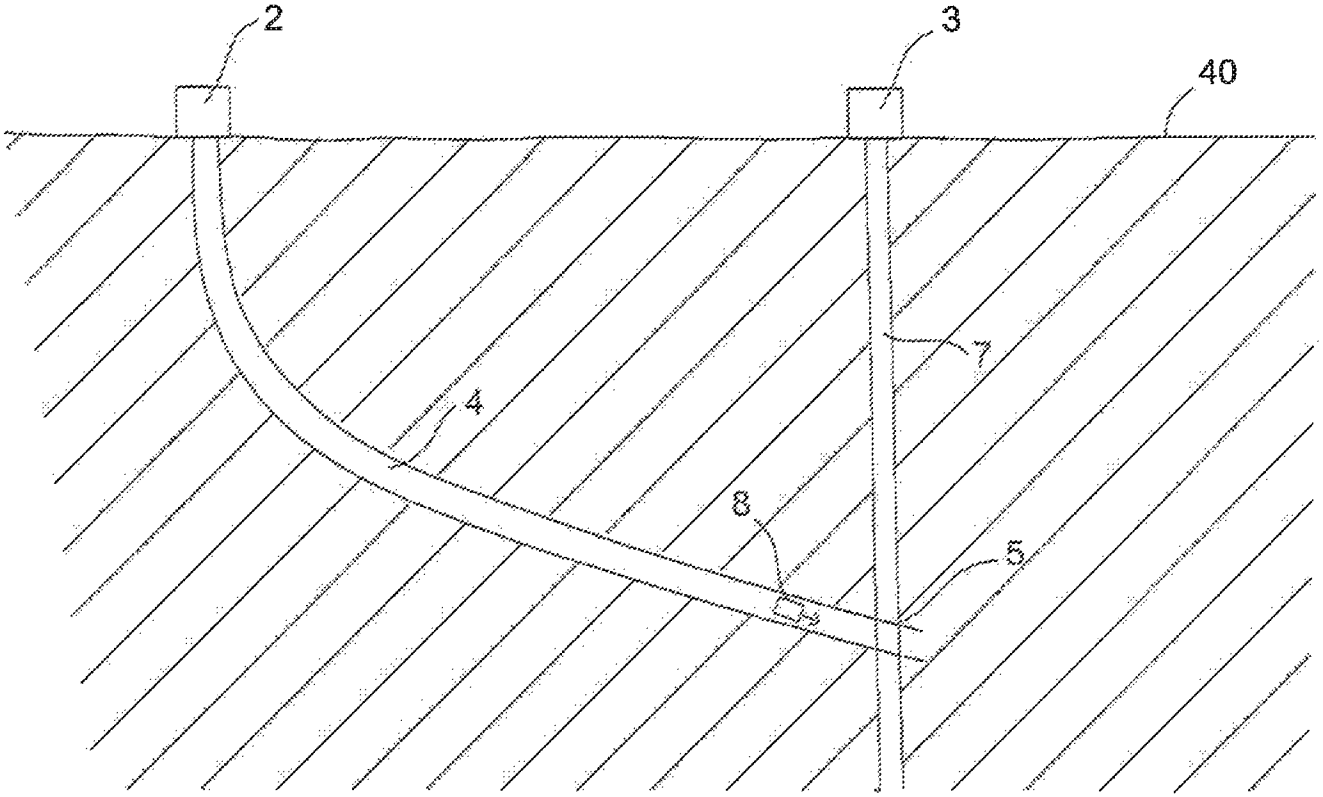
FIG. 2 shows a relief well with a robot.

FIG. 2 shows two wells: 2 and 3, where the well 3 is to function as relief well to the well 2. Here the well 3 is provided with a robot 8, which may be a so-called well tractor. The robot may be of the type which is activated and supplied hydraulically with energy by means of, for example, a tube (not shown) which is passed down into the well via the Blow Out Preventer/Lubricator 2.

Use is typically made of tubes constructed such that they can be rolled onto a roll. Such tubes are called coiled tubing. As compared with a conventional drilling operation where the entire well is to be established, an operation with coiled tubing is a very simple operation, and consequently it can be carried out by far simpler vessels than actual drilling rigs equipped with drilling towers.

A coiled tubing operation, where the well tractor/robot 8 is activated, can thus very well be carried out by ships which normally service drilling rigs, the so-called supply ships.

The well tractor itself, which in the embodiment shown must be capable of drilling through the casing in well 7, can also be of a type being provided with a valve which can break off the fluidwise communication between the lower section (which is positioned below the point at which the wells meet) and the upper section (above the meeting point of the wells) of the well 7.

The well tractor may be provided with electric motors, electronic control, and electric power supply, for example in the form of batteries. Thus, it can be designed for carrying out not only tasks based on an energy supply via coiled tubing, but also pre-programmed special tasks, and it can be activated via for example acoustic signals which may progress via coiled tubing and/or the casing of the well. By a suitable energy supply, which could be, for example, batteries or fuel cells, it would be possible to leave one or more well tractors in the relief well and then activate it (these) for example acoustically via the casing, whereafter the one or several well tractors carry out pre-programmed tasks.

Figure 4:
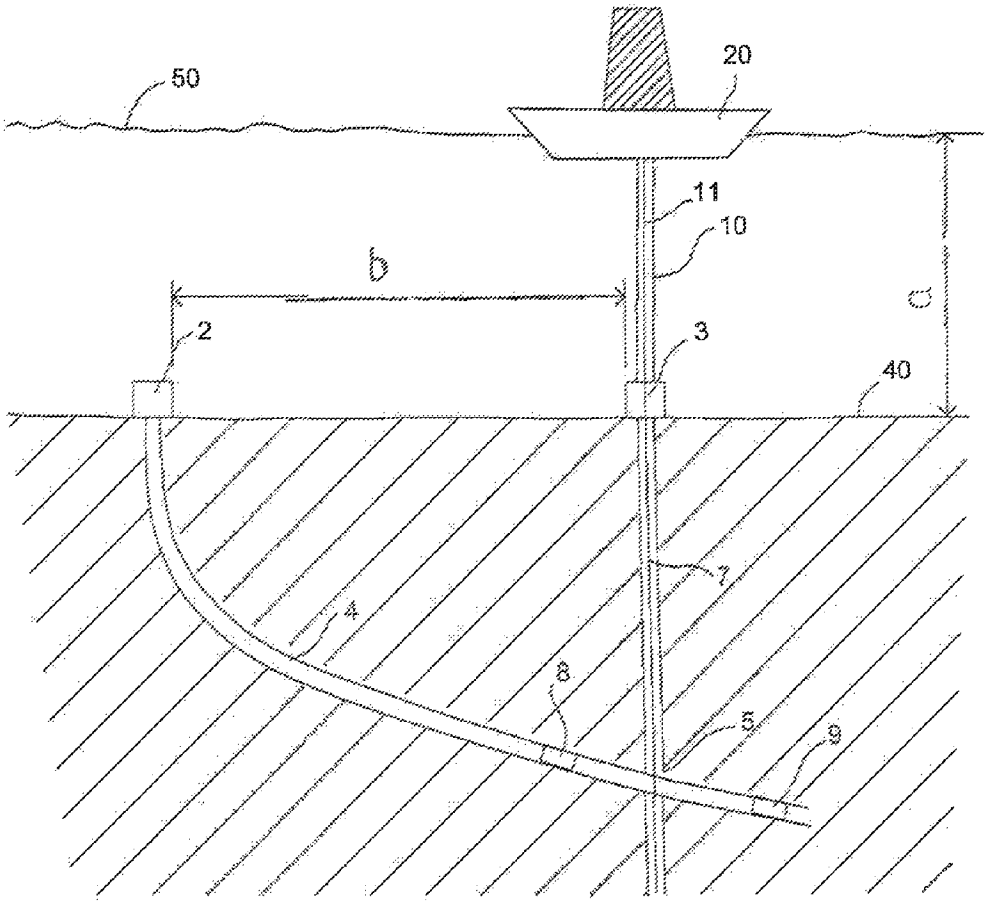
FIG. 4 shows a drilling unit carrying out a method of extracting oil according to the invention.

FIG. 4 shows a scenario where the relief well 4 is filled with a hardening material (seen as hatched area in the figure). By filling the well with a hardening material it is prevented that a very high pressure in the well 7 can propagate to the well 4. This of course involves the disadvantage that the well 4 must be drilled out if it is to be used for intervening in the second well 7.

The drilling per se of a well filled with hardening material is, however, a far simpler operation than establishing a completely new well. Thus, the drilling can also be handled by a vessel, such as for example a supply ship, or an icebreaker equipped with the necessary paraphernalia, which, as it is, do not include an actual drilling tower.

Figure 3:
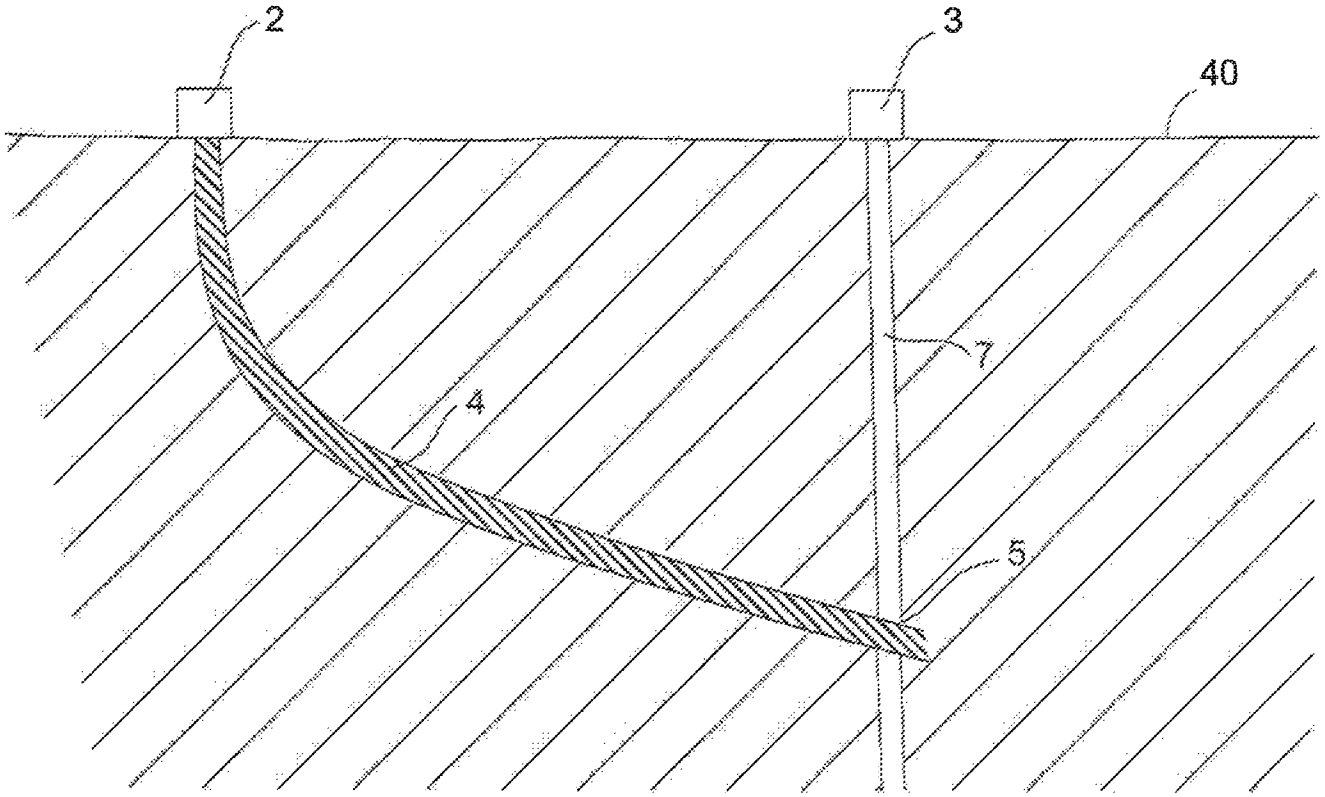
FIG. 3 shows a relief well with cement.

Although the well in FIG. 3 is shown as being completely filled up, embodiments are readily conceivable in which the well is only partially filled. This of course has the advantage that less material must be removed/drilled out if the well is to be used.

FIG. 4 shows an embodiment of the invention in which a vessel 20 (drilling unit), via a riser pipe 10, carries out a drilling operation by means of a drilling string 11.

The well which the vessel is working on is either a test drilling (exploration) down into an underlying supposed reservoir, or a drilling (development) down into an underlying known reservoir. Generally, it could be mentioned that the invention is equally applicable in test drillings as in actual development drillings (development) of known reservoirs.

As is apparent from the figure, the well 4 is here provided with two robots (well tractors) 8 and 9, one of which is positioned on the bottom side of the well 7 while the other is positioned on the top side. By positioning two robots in this manner it is achieved that one of the robots (for example in case of malfunction) does not obstruct the access of the second robot to the well 7. Furthermore, the uppermost robot can also be made hydraulic and activatable via a coiled tubing, while the second robot can be based on electric energy from for example batteries. Both robots can of course also be based on electric energy which could come both from the surface and/or from built-in batteries.

The uppermost robot will be able to thereby perform energy demanding operations, such as for example drilling through of the casing with which the well 7 is provided, while the second robot will be able to perform a—not so energy demanding—special task of, for example, blocking for throughflow of fluid from the underlying portion of well 7.

Even though the invention is explained by many exemplary embodiments in which, from the relief well, an actual fluid blockade is made in the well progressing down into the reservoir, it is not always necessary, however, to make this blockade. In some situations it would thus be possible to gain control of the actual well simply by relieving its pressure via the relief well 4.

FIG. 4 shows two indications of distance:

b, which is the distance between the two wells a, which is the depth of the sea.

By adapting the distance b to the water depth a, it is possible to prevent that a wrecked drilling vessel settles at the sea floor on top of the Blow Out Preventer of well 4. For in many cases the vessel will still be coupled to the riser pipe 10, and by simply adjusting the distance between the wells according to the water depth (the length of the riser pipe), it is thus possible to prevent accidents where the access to well 4 is rendered difficult or completely prevented. In the embodiment shown, the vessel 20 is a drill ship, which may be positioned dynamically.

However, it the vessel 20 is positioned by means of one or more anchor chains, as for example in so-called "turret mooring" where the vessel is anchored so as to be rotatable about riser pipe/drilling string, it should also be taken into consideration that an anchor chain should not collide with the relief well. This can be done for example by lowering the Blow Out Preventer down into the sea bottom. In a situation in which you have to get to the relief well you just have to expose the Blow Out Preventer and possibly move one or more anchor chains.

Figure 5:
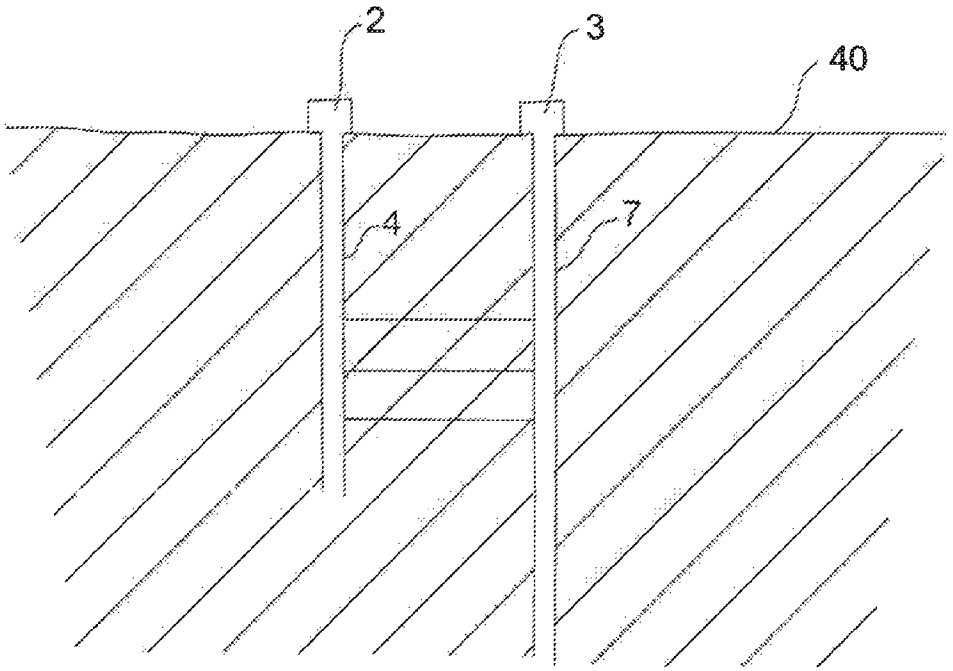
FIG. 5 shows an embodiment of a well system according to the invention.

FIG. 5 shows an embodiment of the invention in which the two wells run essentially in parallel and without great mutual distance. Although the preceding examples all show situations in which the relief well (well 4) physically meets the actual oil well (which is to extend down into the reservoir), it has been acknowledged with the invention that this is not always necessarily the case. For example, a fluidwise communication could be established between the two wells at a later point in time. This can be done, for example, by hydraulically creating fractures between the wells.

Figure 6:
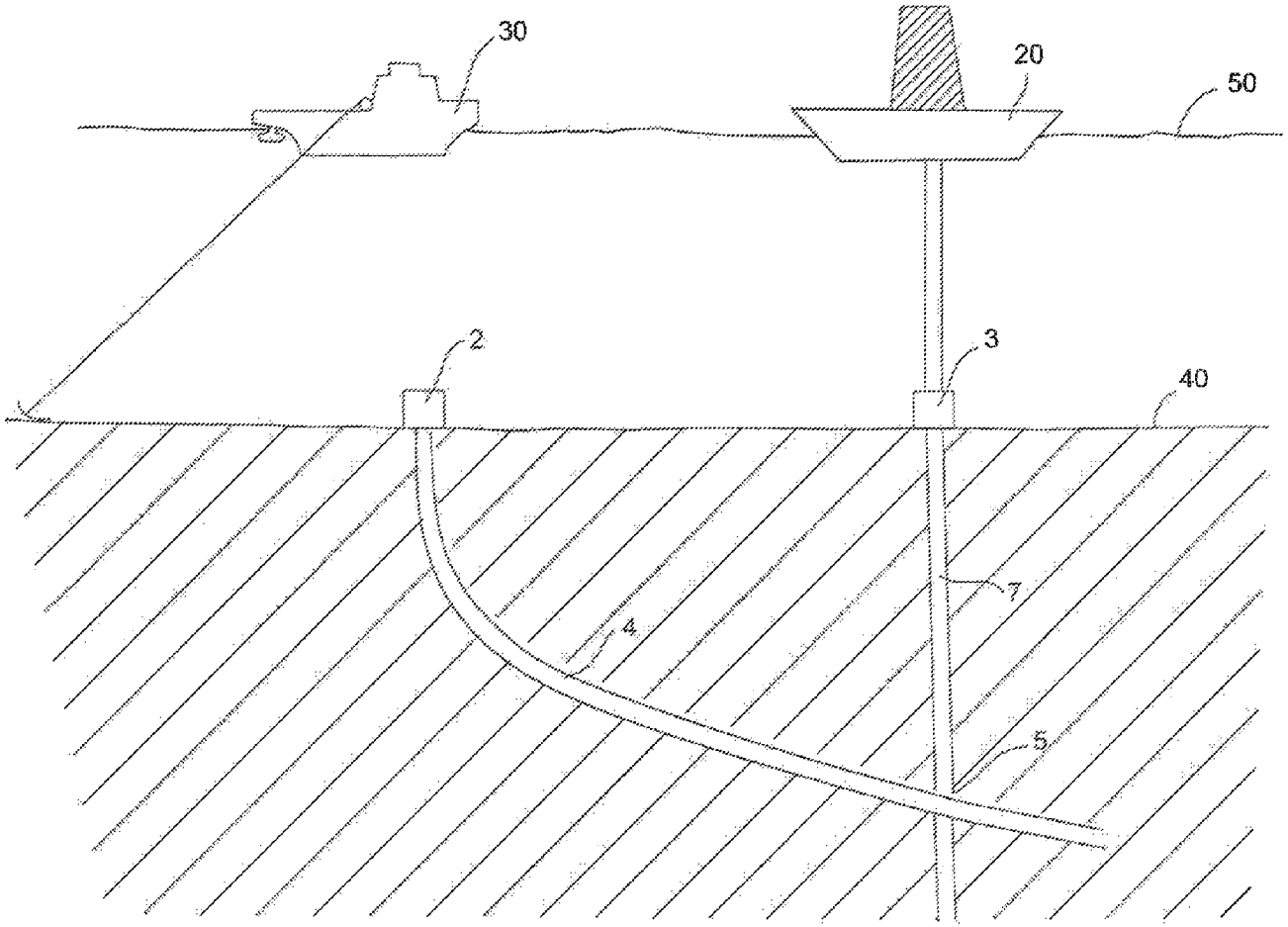
FIG. 6 shows a drilling unit which, with assistance from an icebreaker, carries out a method of extracting oil according to the invention.

It can also be done by use of explosives, or by means of coiled tubing operations in which a tool—which is capable of carrying out the penetration task from one well to the other—is introduced and possibly supplied with energy in the relief well by means of coiled tubing. FIG. 6 shows an embodiment of the invention being used in icy waters. Here a drilling unit 20 carries out a drilling task on an oil well 7, while an assisting icebreaker, equipped with equipment for, for example, intervening the well 7 via the well 4, is anchored parallelly to the direction c of the ice. According to the invention, it is possible to hereby achieve extra safety without requiring an assisting and fully equipped drilling vessel (with derrick) passively standing by.

As explained above, a tool, such as for example a well tractor, may well be introduced into the bottom of a liquid column of, for example, drilling mud which is positioned in the relief well, and furthermore this tractor may also be connected to the top of the well via a tube connection extending through the drilling mud.

Figure 7:
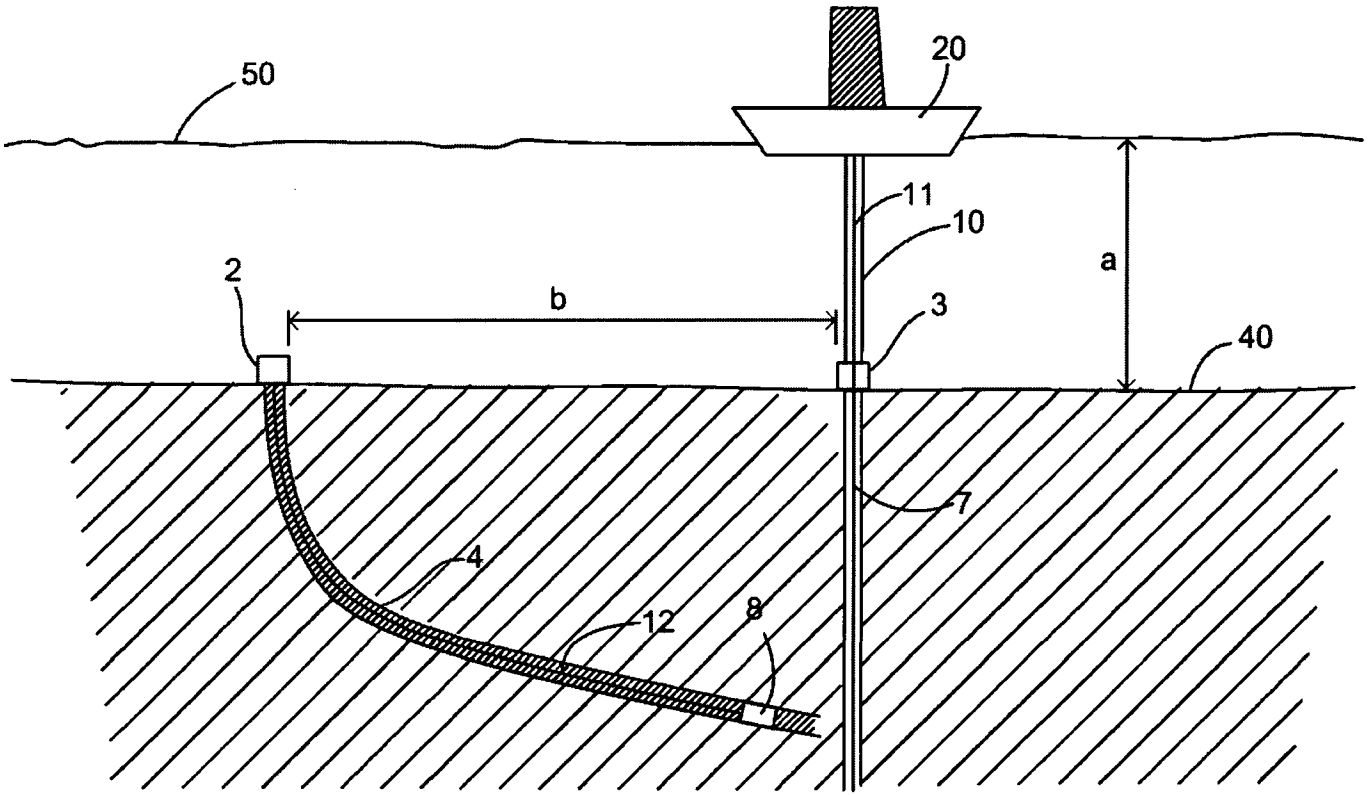
FIG. 7 shows a drilling unit carrying out a method of extracting oil according to the invention where a tool and drilling mud have been introduced into the relief well.

An embodiment hereof is shown in FIG. 7, which shows a drill ship 20, which via a riser pipe 10 is carrying out a drilling operation by means of a drilling string 11. To the left (in the figure) of this operation a relief well 4 extends down into the underground to a place near (operational distance) the well 7 in which the ship is carrying out a well operation.

A hydraulic tool 8 is positioned near the bottom of the relief well 4, the tool being connected to the top 2 of the well 4 via a connection 12. Said connection may be a tube connection so that the tool 8 can be activated hydraulically from the top of the well, but the connection may of course also be an electric connection capable of delivering electric energy to the tool. The tool may also be connected to the top of the well so that data communication can pass between the tool and, for example, a ship which couples to the top of the well. The connection per se between the top of the well and the tool may be an integrated part of an electric cable supplying energy to the tool. However, the connection may also be an integrated part of a hydraulic connection, and may also be a completely independent connection functioning independently of any other connections between tool and the top of the well.

Placing of one or more tools in a well and subsequently closing it so that this well can be accessed at a later point in time and subsequently activating and operating the tool via an electric, hydraulic, or acoustic connection can of course be done independently of other inventions described and disclosed in this application. However, it may also form part of many combinations of these. These aspects can therefore form the basis of an independent protection at a later point in time.

Above and below the tool, the well is drawn hatched. This in order to illustrate how a fluid column 12 may split up on either side of the tool. By placing the tool at the bottom of a fluid column of, for example, drilling mud and at the same time connecting the tool either hydraulically or electrically to the top of the well it is achieved that it is possible to rapidly supply energy to the tool directly from the top of the well. Unlike a tool which is supplied with energy from batteries that you carry with you, a tool which is supplied with energy from an electric wire or via a hydraulic connection can perform much more energy demanding tasks, such as extending (drilling) the relief well further into the well 7.

Hereafter it is possible to inject the drilling mud and/or brine already present in the relief well 4 into the well 7.

In the embodiment shown in FIG. 7, the two wells do not meet, but in one embodiment it is possible to make relief well and oil well 5 so as to physically meet.

A method hereof could comprise the steps: drilling of a first well; mounting and cementing of well pipes in the first well; filling a hardening material into this well; mounting of a Blow Out Preventer or Lubricator in the top of the well; drilling, at a distance from this well, of a second well against a section of the first well so that the second well gets into contact with the first well; mounting and cementing of well pipes in the second well; mounting of a Blow Out Preventer or Lubricator in the top of the second well; whereafter the drilling from the second well is continued down into the reservoir.

By first drilling the relief well and then filling it wholly or partially with hardening material, it is achieved that the actual oil well can penetrate the relief well without immediate danger arising that an uncontrollable situation in the oil well propagates to the relief well.

However, should an uncontrollable situation arise in the oil well, the relief well can very easily be drilled out, and thereby fluid communication has been established between the two wells to the effect that control can be gained of the oil well via the relief well.

Although, as explained above, relief well and oil well meet, the relief well can, in embodiments of the invention, be established with a cavity above the hardening material, which allows the relief well to also be established with a liquid column of drilling mud/brine and a tool as stated in claims 5-14.

However, if expectedly the tool is not to perform tasks requiring much energy, it is of course possible to design the tool in such manner that it gets its energy from a battery which will normally accompany the tool down into the relief well. Although the tool gets its energy from a battery, it can, of course, still be supplied by a hydraulic and or electric connection, or any combination thereof.

Other aspects of the invention.

In a first aspect of the invention, it concerns a method of extracting oil from a reservoir, which method comprises the following steps: drilling of a first well; mounting and cementing of well pipes in the first well; mounting of a Blow Out Preventer or Lubricator in the top of the well; drilling, at a distance from this well, of a second well against a section of the first well to the effect that the second well gets into operational contact with the first well; mounting and cementing of well pipes in the second well; mounting of a Blow Out Preventer or Lubricator in the top of the second well; whereafter the drilling from the first or second well continues down into the reservoir.

In a second aspect of the invention, it concerns a method of extracting oil according to aspects 1-2, characterized in that the drilling down in the reservoir is done from the first well.

In a third aspect of the invention, it concerns a method of extracting oil according to aspect 1, characterized in that the drilling down into the reservoir is done from the second well.

In a fourth aspect of the invention, it concerns a method of extracting oil according to aspects 1-3, characterized in that the drilling of the second well against the first well is done as directional drilling.

In a fifth aspect of the invention, it concerns a method of extracting oil according to aspects 1-4, characterized in that on the top of the well which is continued down into the reservoir there is mounted a riser pipe on its Blow out Preventer.

In a sixth aspect of the invention, it concerns a method of extracting oil according to aspects 1-5, characterized in that the first and the second well meet.

In a seventh aspect of the invention, it concerns a method of extracting oil according to aspects 1-6, characterized in that the well which not drilled to the reservoir is partially filled with hardening material.

In an eight aspect of the invention, it concerns a method of extracting oil according to aspects 1-6, characterized in that the well that is not drilled to the reservoir is filled with hardening material.

In a ninth aspect of the invention, it concerns a method of extracting oil according to aspects 1-8, characterized in that prior to the feature where drilling is performed down into the reservoir from one of the wells, a drilling tool is placed in the other one.

In a tenth aspect of the invention, it concerns a method of extracting oil according to aspect 9, characterized in that the drilling tool is hydraulically activatable.

In an eleventh aspect of the invention, it concerns a method of extracting oil according to aspect 10, characterized in that the drilling tool is hydraulically activatable via coiled tubing.

In a twelfth aspect of the invention, it concerns a method of extracting oil according to aspect 11, characterized in that the drilling tool comprises a well tractor being mutually adapted to a section of the well casing so as to be firmly lockable.

In a thirteenth aspect of the invention, it concerns a method of extracting oil according to aspects 5-12, characterized in that the distance between the wells is adapted to the length of the riser pipe in such a manner that, in the event that it sinks, the vessel performing a drilling down into the reservoir cannot fall down onto the second well.

The invention claimed is:

1. A method of extracting oil from a reservoir, the method comprising:

drilling a first well;

mounting and cementing well pipes in the first well;

mounting a first blow out preventer or first lubricator in a top of the first well;

drilling a second well against a section of the first well, wherein a first distance between the top of the first well and a top of the second well is greater than a length of a riser pipe that connects the first well to a drilling unit, and wherein a second distance between a lower portion of the second well and the first well is smaller than the first distance and facilitates establishment of a connection between the lower portion and the first well by a drilling tool;

mounting and cementing well pipes in the second well;

mounting a second blow out preventer or second lubricator in the top of the second well;

continuing to drill the first well down into the reservoir;

filling the second well at least partially with a fluid;

placing the drilling tool in the second well; and closing the second well, wherein placement of the drilling tool in the second well facilitates establishment of the connection between the second well and the first well when the second well is accessed.

2. The method according to claim 1 further comprising filling the second well at least partially with a fluid of hardening material.

3. The method according to claim 2, wherein the fluid constitutes a liquid column; and the method further comprises placing the drilling tool on one side or both sides of the liquid column, the drilling tool being capable of establishing a connection to the second well, or injecting the fluid into the second well.

4. The method according to claim 2, further comprising positioning a hydraulic tool below or in the lower portion of the liquid column.

5. The method according to claim 2, further comprising placing an electric tool below or in the lower portion of the liquid column.

6. The method according to claim 5, further comprising supplying energy to the tool via a wire extending therefrom and through the column of fluid to the top of the second well.

7. The method according to claim 1, further comprising filling the second well at least partially with drilling mud or a combination of drilling mud and brine.

8. The method according to claim 7, wherein the fluid constitutes a liquid column; and the method further comprises placing the drilling tool on one side or both sides of the liquid column, the drilling tool being capable of establishing a connection to the second well, or injecting the fluid into the second well.

9. The method according to claim 7, further comprising positioning a hydraulic tool below or in the lower portion of the liquid column.

10. The method according to claim 1, wherein the fluid constitutes a liquid column; and the method further comprises placing the drilling tool on one side or both sides of the liquid column, the drilling tool being capable of establishing connection to the second well, or injecting the fluid into the second well.

11. The method according to claim 10, further comprising positioning a hydraulic tool below or in the lower portion of the liquid column.

12. The method according to claim 10, wherein the fluid constitutes a liquid column comprising drilling mud or a combination of drilling mud and brine.

13. The method according to claim 12, further comprising positioning a hydraulic tool below or in the lower portion of the liquid column.

14. The method according to claim 13, further comprising providing the hydraulic tool with a hydraulic connection of a coiled tubing type.

15. The method according to claim 13, further comprising providing the hydraulic tool with a hydraulic connection extending from the hydraulic tool and through the liquid column of brine or combination of brine and drilling mud to the top of the second well.

16. The method according to claim 15, further comprising providing the hydraulic tool with a hydraulic connection of a coiled tubing type.

17. The method according to claim 12, further comprising providing the drilling tool with a communication unit that facilitates transfer of data between the drilling tool and the top of the second well, wherein the data facilitates control of the drilling tool or transfer of physical parameters associated with the drilling tool.

18. The method according to claim 17, wherein the parameters include at least one of: pressure, temperature, and control parameters as to the functionality of the tool.

* * * * *